US005845436A

United States Patent [19]

Nota

[11] Patent Number: 5,845,436

[45] Date of Patent: Dec. 8, 1998

[54] GRAVE-MARKER SUPPORT DEVICE

[76] Inventor: Joseph C. Nota, 17 Riley St., Lewiston, Me. 04240

[21] Appl. No.: 53,839

[22] Filed: Apr. 1, 1998

[51] Int. Cl.[6] ..... E04H 13/00

[52] U.S. Cl. ..... 52/103; 52/105; 52/169.7; 40/124.5

[58] Field of Search ..... 52/103, 169.7, 52/105; 40/124.5; 248/530, 156; 47/39, 41.1, 65.6, 75, 65.5

[56] References Cited

U.S. PATENT DOCUMENTS

| | | | |
|---|---|---|---|
| 1,963,804 | 6/1934 | Powell . | |
| 1,971,075 | 8/1934 | Lockwood . | |
| 2,045,189 | 6/1936 | Judd | 47/65.5 |
| 3,001,326 | 9/1961 | O'Brien et al. . | |
| 3,052,065 | 9/1962 | Rettman . | |
| 3,604,172 | 9/1971 | Matvey | 40/124.5 X |
| 3,758,999 | 9/1973 | Matvey | 52/103 |
| 4,108,439 | 8/1978 | McGuire . | |
| 4,173,097 | 11/1979 | Staby | 47/65.5 |
| 5,315,783 | 5/1994 | Peng | 47/65.6 |

*Primary Examiner*—Robert Canfield
*Attorney, Agent, or Firm*—Thomas L. Bohan

[57] ABSTRACT

A support structure that provides a stable housing for grave-markers. The grave-marker support device is highly resistant to the effects of seasonal freezing and thawing and of raining and drying cycles. The grave-marker support maintains the grave-marker in a substantially horizontally-oriented position without undesirable sinking effects. This is accomplished by forming the grave-marker with a structurally-sound flange that is reinforced by a rigid curled-under edge or lip. The flange is attached to a basin that conforms substantially to the shape of the grave-marker and within which the grave-marker rests. Grooves within the basin's bottom surface channel water to an outlet to facilitate drainage. Further, the bottom surface may include raised notches that support the grave-marker in an elevated manner within the basin to enhance drainage even more.

18 Claims, 3 Drawing Sheets

GRAVE-MARKER SUPPORT DEVICE

BACKGROUND OF THE INVENTION

1. Field of the Invention

The present invention relates to the field of grave-marker devices. More particularly, the present invention relates to a device for providing alignment and support of a grave-marker. More particular yet, the present invention involves a unitary support device for holding a grave-marker, where the grave-marker is of the substantially-flat, horizontally-oriented type and retained in place via the support device.

2. Description of the Prior Art

Markers used at a grave-site are typically made from relatively permanent materials. Such markers may be made from durable natural materials such as granite or marble and sometimes they are made from manufactured materials such as concrete, bronze, or steel. These markers come in varied shapes and sizes. While markers do exist in ornate forms such as angelic statues or in some effigy of the deceased, etc., many markers are of a conventional tablet design, i.e., a flat surface with etched lettering. This conventional tablet is oriented either horizontally or vertically. Such tablet is commonly referred to as a headstone, gravestone, grave-marker, memorial-stone, memorial-marker, or the like. For purposes of this application, the term "grave-marker" will be used throughout. Further, grave-marker shall be used to denote the horizontally-oriented type of conventional tablets.

Grave-markers are typically set into the earth by excavating a hole in the ground that generally conforms to the rectangular block shape of the grave-marker. This is accomplished in much the same manner as a conventional pave-stone is set in place to form a walking path. The grave-marker is usually placed in direct contact with the soil. Variations in marker sites, and the difficulty in efficiently excavating the hole to ensure a tight fit of the marker therein, can accelerate damage to the marker. A marker that protrudes above the surface of the hole can be damaged during maintenance procedures. A marker that is positioned below the surface will be difficult to observe due to likely vegetation overgrowth. At a number of gravesites, particularly those military gravesites, the markers that are flush to the ground are commonplace. Their use is on the rise and when limited resources to conflict with a strong interest in maintaining the dignity of such facility, it is important that the memorialization process be efficient without compromising the quality of the site. Unfortunately, the soil contacting the grave-marker can result in corrosion or discoloration of the grave-marker. Moreover, constant moisture within the soil commonly leaches into the material of the grave-marker and can lead to a physical breakdown of the grave-marker through the related hydrostatic forces. Yet further, the fluidic nature of the earthen soil surrounding the grave-marker exacerbates movements of the grave-marker. Freeze/thaw cycles combine to heave the grave-marker out of its horizontal position. Additionally, over time, it is common for the markers to sink into the ground, making these observations, as well as maintenance, difficult. A variety of prior art devices have attempted to solve these problems.

The device of Matvey (U.S. Pat. No. 3,650,072) is one such prior-art attempt at stabilizing grave-markers. The device of Matvey ('072) is a protective device for grave marking structures that is basically a frame designed to surround such structures. The device of Matvey ('072) acts as a skirt around the grave structure and serves to inhibit growth of weeds and grass at the immediate edges of the grave structure. This arrangement, however, becomes increasingly inadequate over time. Due to cyclic natural forces of wetting/drying and freezing/thawing, the grave structure begins to sink. This is especially common to the grave structure as shown in use with the device of Matvey ('072)—i.e., grave-markers which are horizontally-oriented and flush with the ground surface. When the grave-marker sinks, a recess is created which recess readily fills with soil particles and organic matter. Over time, a build-up of dirt is created atop the grave-marker that is itself sufficient to support growth of weeds and grass. In this manner, the device of Matvey ('072) is rendered useless due to overgrowth on the sunken grave-marker.

A subsequent device of Matvey (U.S. Pat. No. 3,758,999) is another prior-art protective grave-marking structure. This second device of Matvey ('999) is a frame that surrounds the periphery of a grave-plaque which plaque is bolted to a footing. The frame is sandwiched between the plaque and the footing and firmly compressed therein by tightening of the bolt. This type of device must be secured prior to in-ground placement of the grave-plaque, and it is not suitable for the un-bolted stone slab type of grave-marker. Still further, the device of Matvey ('999) fails to provide any lateral securing mechanism. Accordingly, migration of the device due to expansion and compression over time from its sandwiched position will result in lateral movement of the device. In particular, the flat peripheral edge is free to move.

Accordingly, the prior art fails to provide any support device that is suitable for use with grave-markers—particularly grave-markers in the form of a single horizontally-oriented stone slab. All prior devices suffer from one or more of the following flaws: (1) they are complex structures consisting of more than one piece; (2) they are not easily assembled; (3) they are not rigid and durable; (4) they do not prevent lateral movement of the grave-marker; (5) they do not provide adequate drainage; and (6) they do not provide an aesthetically-pleasing, or at least unassuming, frame around a grave-marker.

Therefore, what is needed is a grave-marker support device that is easy to manufacture, use, and install. More specifically, what is needed is such a device that is a durable structure. What is also needed is such a device that provides support for grave-markers and that does so in a way that ensures the surface of the marker will be easy to maintain and view. Further, what is needed is such a device that allows proper drainage of water therefrom. Yet further, what is needed is such a device that can be easily fabricated in a variety of colors and textures blend in with the area surrounding the grave-marker.

SUMMARY OF THE INVENTION

It is an object of the present invention to provide a grave-marker support device that is easy to make, use, and install. Another object of the present invention is to provide such a device that is a durable, one-piece structure. Yet another object of the present invention is to provide such a device that supports grave-markers against in-ground movement—especially against sinking. Still another object of the present invention is to provide such a device that allows proper drainage of water from the device. It is an object of the present invention to provide such a device that can be easily fabricated in a variety of colors and textures to blend in with the area surrounding the grave-marker if that is of interest.

These and other objectives are achieved in the present invention through the introduction of a unitary support device. The device of the present invention includes a first portion that is formed in the shape of a basin and a second portion that forms a peripheral flange that surrounds the top-most edge of the first portion. The walls of the first portion are preferably tapered inwardly so as to securely wedge a grave-marker therewithin. This tapering and the flange allow the device to be placed into a hole having relatively inexact measurements. In that way, the trim required to excavate the placement hole can be minimized.

The bottom of the first portion of the support device is substantially flat, although it preferably is tapered from the perimeter toward the center. The bottom includes a central hole, and may optionally include other drainage holes, to allow water to drain therethrough. The bottom also has channels radiating outward from the central hole. These channels are designed to be pathways for water flow from the interior perimeter of the support to the central hole. The channels also provide some structural integrity to the support. Any channels may be used, although structural rigidity should be maintained and therefore limits the use of channels as well as the number of holes. The bottom of the first portion may also include a plurality of stops or blocks. Each stop is a raised portion of the bottom near a wall. The stops function to keep the grave-marker raised within the first portion. This facilitates proper drainage by providing a gap between the grave-stone and bottom of the first portion.

The second portion is a relatively rigid peripheral flange that includes a curved lip located at the outermost edge of the flange such that the second portion is initially flat and it then curves outwardly and downwardly from a marker located within the basin. The top surface of this second portion may be textured and/or colored to match grass, moss, gravel, sand, or any pleasing arrangement. The flange and its lip should be suitably thick and long enough to provide structural rigidity to the device given the load of the marker to be supported. The flange acts as a brace on the ground surrounding the hole. The lip, which is preferably rounded downwardly on the flange perimeter, is designed to grip the ground to prevent lateral movement of the device when the marker is placed within the support. That is, the lip effectively bites into the ground G, while the flat portion that is the flange rests flush on the surface of the ground G. The lip prevents the entire unit from sinking into the ground and the flange provides structural support to the lip. The addition of a lip is also beneficial to the design in that a molded straight flange tends to curl upwardly at its edge. A marker support with an upwardly-curled flange would likely sink into the ground faster than a simple flat flange.

Overall, the second portion provides enough surface area that contacts the ground so as to substantially eliminate sinking of the grave-stone. Also, the lip increases structural rigidity and thus prevents sagging of the flange and reduced sinking of the entire support. Both the first and second portions are formed preferably as a single piece of material. Durability being of foremost concern, the device may be made from any metal or plastic that is non-corrodible and resistant to temperature extremes. The device may be fabricated by any suitable method such as, but not limited to, injection molding, stamping, casting, and machining.

It is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

DETAILED DESCRIPTION OF THE PREFERRED EMBODIMENT

Figure 1:
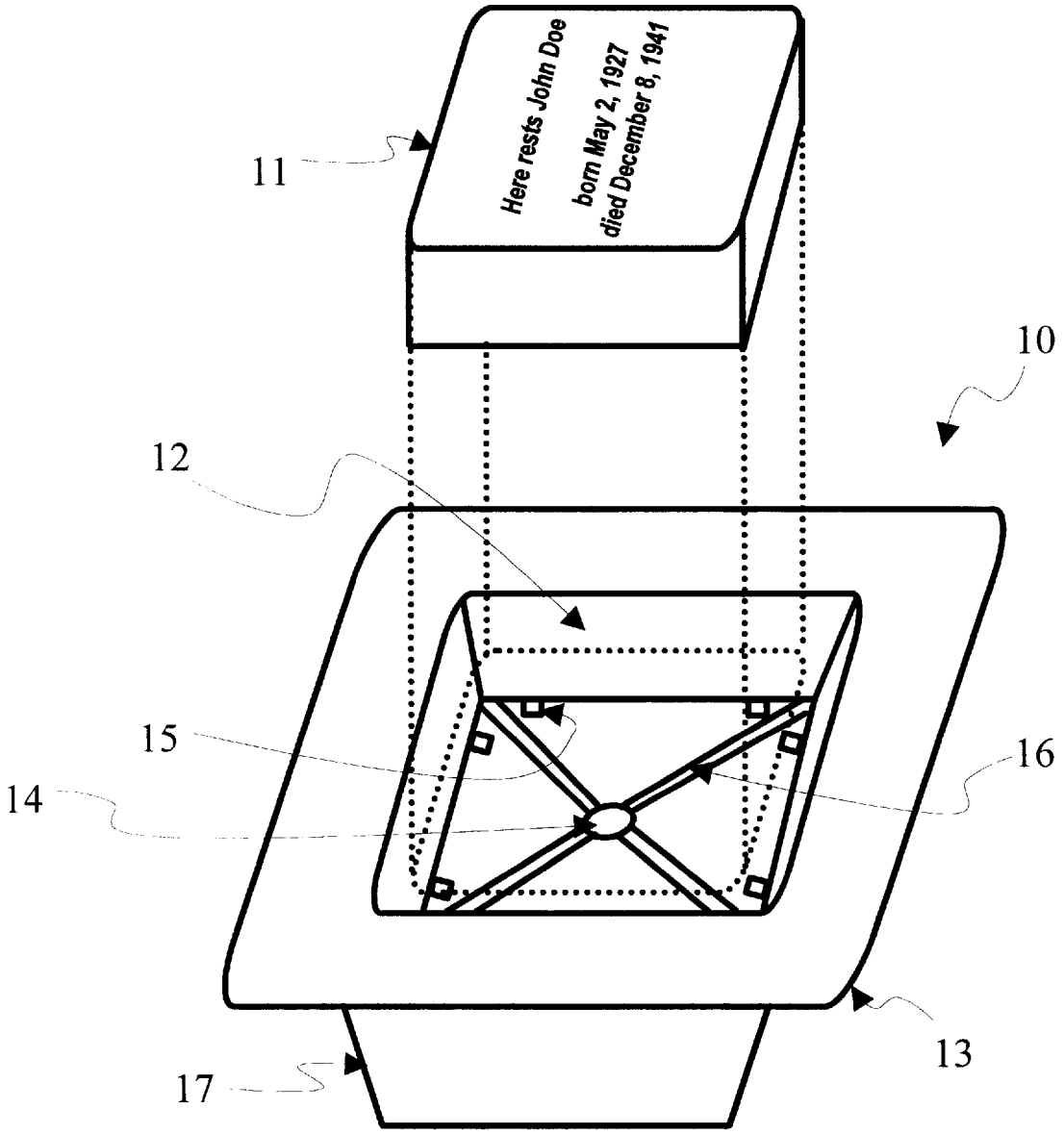
FIG. 1 is a perspective view of the device according to the present invention and showing grave-marker placement therein.

FIG. 1 shows a grave-marker support device 10 of the present invention with a typical flush grave-marker 11 superimposed above opening 12. The support device 10 includes a basin 17 and a flange 13. The flange 13 has a lip (shown in detail in FIGS. 3—5 as element 13*a*) located underneath its peripheral edge. The lip is preferably a rounded and curled-under section of the flange 13. As can be seen, the basin 17 is tapered in a narrowing manner from top to bottom to create a trapezoidal shape. Along the bottom of the basin 17, there is a central hole 14 that allows water to exit the basin 17. In order to facilitate such drainage, the basin 17 also includes channels 16 that are preferably recessed within the bottom of the basin 17 and are inclined towards the central hole 14. While various numbers of channels and holes can be used, it is preferable to use four radially-situated channels and one central hole as shown. This arrangement has been shown to be suitably rigid and thus structurally sound for the purposes used.

Further as shown in FIG. 1, the basin 17 preferably includes stops 15 that are located around the bottom inner-periphery of the basin. These stops 15 are raised portions of the bottom surface of the basin 17. The stops 15 are used to maintain the grave-marker 11 a small distance above the bottom of basin 17. This further facilitates proper drainage and allows for a space in which trapped frozen water may expand without raising, or otherwise displacing, the grave-marker 11. It should be noted that the basin 17 and flange 13 are preferably formed together as a one-piece unit, and is preferably made of a plastic such as polypropylene or polyethylene. This aids in manufacture of a variety of sizes, colors, and textures. The top-most exposed surface 18 that forms the flange 13 is preferably textured to emulate the natural earthen surface that normally surrounds the grave-marker 11 in a typical cemetery.

Figure 2:
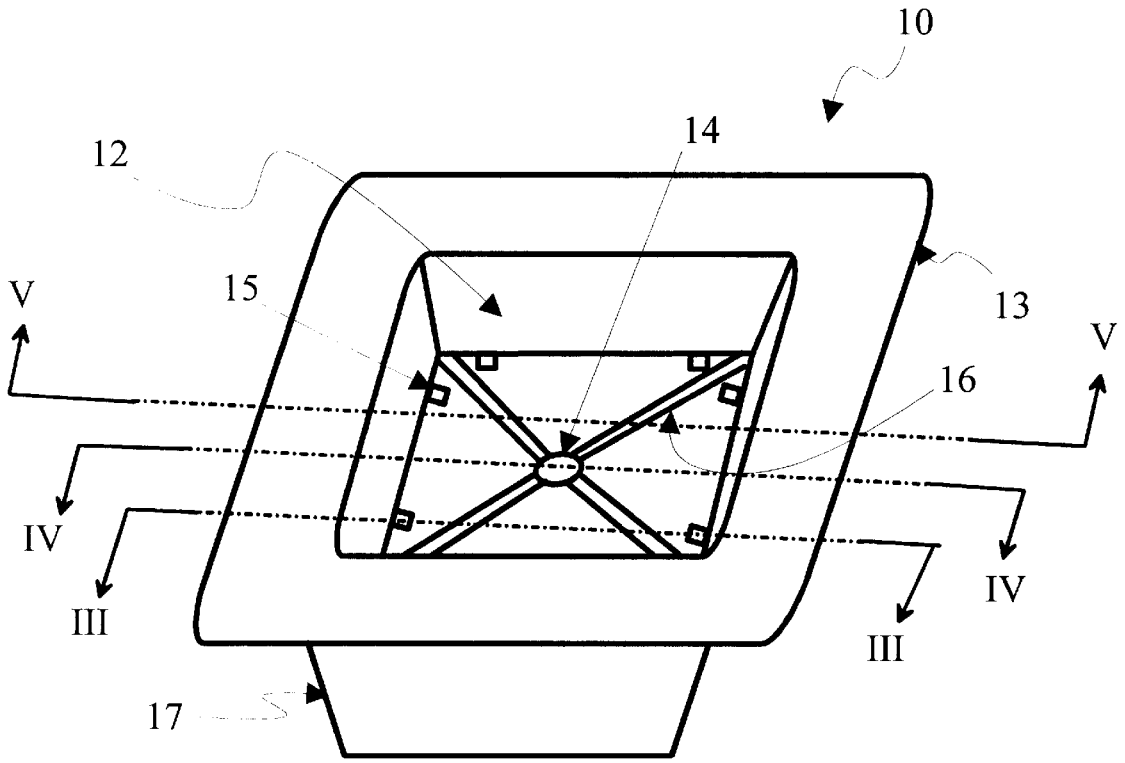
FIG. 2 is a perspective view of the device according to the present invention as shown in FIG. 1 with cross-sectional lines shown for illustrating FIGS. 3–5.
Figure 3:
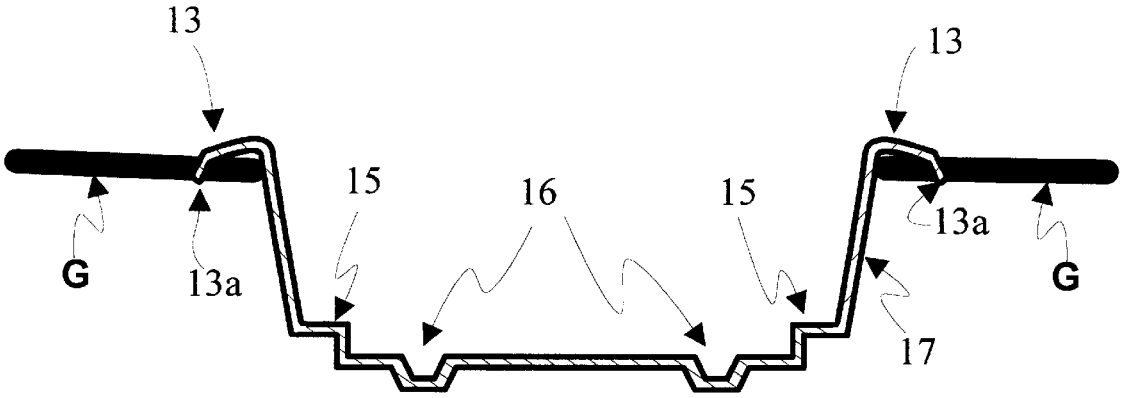
FIG. 3 is a cross-sectional view taken through line III—III of FIG. 2 showing channels and stops.
Figure 4:
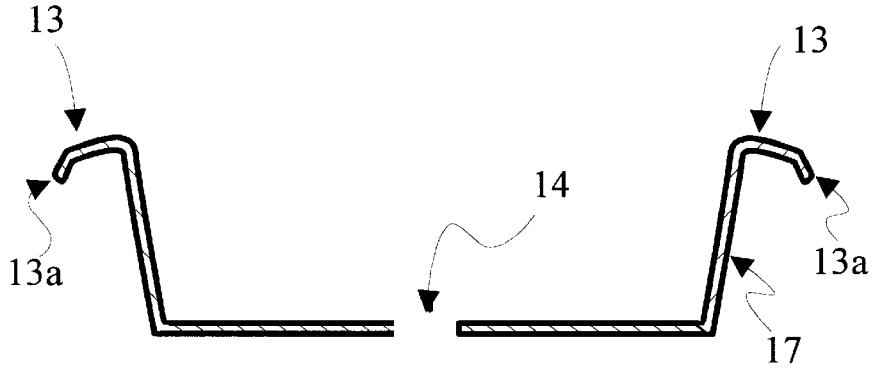
FIG. 4 is a cross-sectional view taken through line IV—IV of FIG. 2 showing the central hole.
Figure 5:
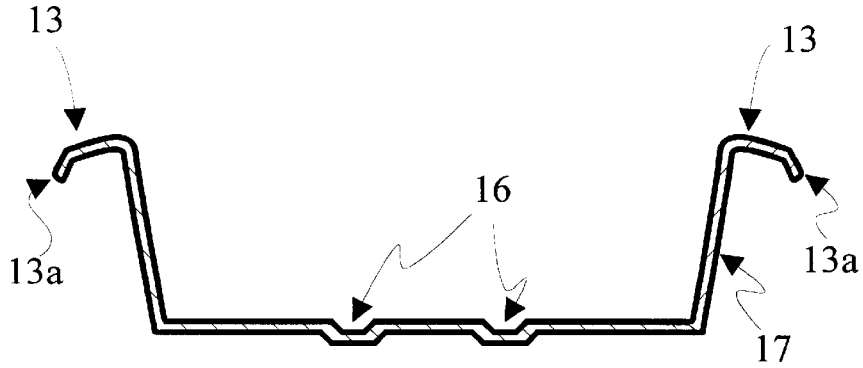
FIG. 5 is a cross-sectional view taken through line V—V of FIG. 2 showing channels.

FIG. 2 shows the aforementioned features of the device 10. The cross-sections III—III, IV—IV, and V—V from which FIGS. 3, 4, and 5 are derived are also shown in FIG. 2. The cross-section view of FIGS. 3–5 all show how the basin 17 tapers and that the flange 13 includes a lip 13*a*. The lip 13*a* is designed to grip into the earthen surface that surrounds the support device 10 in-situ within a cemetery. More specifically, in FIG. 3, the channels 16 and stops 15 are shown in detail. As can be seen, the lip 13*a*, flange 13, basin 17, stops 15, and channels 16 all form one continuous slice through the cross-section of the support device 10. The lip 13*a* is preferably formed in a rounded design as shown in order to reduce the effects of curling generally associated with fabricated plastic parts. FIG. 4 is similar to FIG. 3 except that it represents a cross-section across the middle of the support device 10. In this way, FIG. 4 shows the central hole 14 which is within the basin 17. In FIG. 5, the channels 16 are shown as they appear toward the center of the basin 17.

It should be understood that the preferred embodiments mentioned here are merely illustrative of the present invention. Numerous variations in design and use of the present invention may be contemplated in view of the following claims without straying from the intended scope and field of the invention herein disclosed.

I claim:

1. A support device for use with horizontally-oriented grave markers, said device comprising:

a) a basin having a means for providing drainage, said basin being capable of receiving a horizontally-oriented grave marker; and b) a flange attached to said basin, said flange having a substantially flat portion and a lip attached to a bottom peripheral edge of said flange, wherein said basin is designed to create a retaining space sufficient to support a grave-marker therein and wherein said flat portion of said flange rests flush on a ground surface of a grave and said lip bites into said ground surface.

2. The device as claimed in claim 1, wherein said means for providing drainage includes one or more holes in a bottom of said basin and at least one channel leading to said one or more holes.

3. The device as claimed in claim 2, wherein said bottom of said basin includes at least two stops, where each of said stops is located at an edge of said bottom of said basin.

4. The device as claimed in claim 3, wherein said one or more holes includes a hole being located centrally within said bottom of said basin.

5. The device as claimed in claim 4, wherein said basin includes exactly four channels, each said channel extending from a corner of said basin towards said centrally-located hole.

6. The device as claimed in claim 5, wherein said basin includes exactly eight stops, where each of said stops is located adjacent to an interior corner of said basin.

7. The device as claimed in claim 6, wherein said basin and said flange are fabricated from a single piece of durable material.

8. The device as claimed in claim 7, wherein said durable material is plastic.

9. The device as claimed in claim 8, wherein a top surface of said flange is formed in a textured pattern.

10. A support device for use with horizontally-oriented grave markers, said device comprising:

a) a basin having a central drainage hole and a plurality of channels leading towards said central drainage hole, said hole and said channels being formed in a bottom surface of said basin, said basin being capable of receiving a horizontally-oriented grave marker; and b) a flange attached to said basin, said flange having a substantially flat portion and a lip attached to a bottom peripheral edge of said flange, wherein said basin is designed to create a retaining space sufficient to support a grave-marker therein and wherein said flat portion of said flange rests flush on a ground surface of a grave and said lip bites into said ground surface.

11. The device as claimed in claim 10, wherein said bottom of said basin includes a plurality of stops formed therein, where each of said stops is located in an elevated manner at an edge of said bottom of said basin.

12. The device as claimed in claim 11, wherein each of said channels slope downward from an outer periphery of said basin towards said drainage hole.

13. The device as claimed in claim 12, wherein said basin includes tapered walls, said tapered walls being narrower towards said bottom of said basin.

14. The device as claimed in claim 13, wherein said device is fabricated from a single piece of durable plastic.

15. The device as claimed in claim 14, wherein a top surface of said flange is formed in a textured pattern suitable to match an area of earth surrounding said grave-marker.

16. The device as claimed in claim 5, wherein said basin has a perimeter and said bottom is tapered from said perimeter toward said centrally-located hole.

17. The device as claimed in claim 8, wherein said single piece is formed by injection molding.

18. The device as claimed in claim 7, wherein said durable material is a metal.

* * * * *